US006539651B1

(12) United States Patent
Rius et al.

(10) Patent No.: US 6,539,651 B1
(45) Date of Patent: Apr. 1, 2003

(54) IRONING SHOE AND ELECTRIC STEAM IRON

(75) Inventors: Antonio Rebordosa Rius, Barcelona (ES); Miquel Vázquez, Barcelona (ES); Remedios Pozo-Marin, Barcelona (ES); Desideri Falcó , Barcelona (ES); Pedro Pérez, Cornella (ES); Xavier Cuesta, Barcelona (ES); Juan Carlos Coronado-Sanz, Barcelona (ES)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/506,707

(22) Filed: Feb. 18, 2000

(30) Foreign Application Priority Data

Feb. 22, 1999 (EP) ..... 99103365

(51) Int. Cl.[7] ..... D06F 75/38
(52) U.S. Cl. ..... 38/81
(58) Field of Search ..... 38/81, 80, 97, 38/93, 88

(56) References Cited

U.S. PATENT DOCUMENTS 1,971,759 A * 8/1934 Olds ..... 38/88
2,553,274 A * 5/1951 Pohl ..... 219/251
2,612,587 A * 9/1952 Guerra ..... 219/254
5,220,738 A * 6/1993 Baldacci ..... 219/256
5,623,775 A * 4/1997 Farrington et al. ..... 38/88
6,018,897 A * 2/2000 Lin ..... 219/254

* cited by examiner

*Primary Examiner*—Ismael Izaguirre
(74) *Attorney, Agent, or Firm*—Fish & Richardson P.C.

(57) ABSTRACT

The invention is directed to an ironing shoe with a fastening device for fastening and releasing the fastener of a pressing surface of an electric steam iron, with a soleplate base having soleplate openings for the discharge of steam, the underside of which is used for ironing the article needing to be ironed and the upper side of which has disposed thereon an insert arrangement having insert openings for the passage of steam from the steam iron to the soleplate openings. In order to improve the utility characteristics of the ironing shoe and in particular of the insert arrangement, it is proposed providing the insert arrangement with a capillary layer made of a moisture-absorbing material on the side close to the upper side of the soleplate base, and with an impermeable layer on the side close to the steam iron.

17 Claims, 5 Drawing Sheets

IRONING SHOE AND ELECTRIC STEAM IRON

BACKGROUND OF THE INVENTION

1. Field of the Invention

This invention relates to an ironing shoe with a fastening device for fastening and releasing the fastener of a pressing surface of an electric steam iron, with a soleplate base having soleplate openings for the discharge of steam, the underside of which is used for ironing the article needing to be ironed and the upper side of which has disposed thereon an insert arrangement having insert openings for the passage of steam from the steam iron to the soleplate openings. The present invention relates in addition to an electric steam iron with a detachable ironing shoe.

2. Description of the Related Art

An ironing shoe of this type is known in the art from DE 2 612 848. In this disclosure the soleplate base is equipped with a perforation into which an insert made of tetrafluoroethylene or silicate rubber is inserted. The insert has a large insert opening so that no diminishing of the steam pressure results from the insert itself but a certain diminishing of the steam pressure can arise due to the fine perforation in the soleplate base. Droplets of condensate can form disadvantageously and be discharged as droplets through the soleplate base onto the article to be ironed. Furthermore, fastening the ironing shoe to a steam iron is a relatively elaborate operation.

SUMMARY OF THE INVENTION

It is an object of the present invention to provide an ironing shoe and an electric steam iron having a detachable ironing shoe of the type initially referred to, which features optimal utility characteristics.

This object is accomplished by an ironing shoe incorporating the features of claim 1 and by an electric steam iron incorporating the features of claim 11.

Advantageously, the insert arrangement comprises a capillary layer made of a moisture-absorbing material inserted in the soleplate base so that it is arranged on the upper side of the soleplate base, meaning the side facing away from a pressing surface on the soleplate base. In addition, the insert arrangement comprises an impermeable layer or insert element arranged on the side close to the steam iron. The capillary layer of this multi-layer insert arrangement prevents droplets of condensate from the conveyed hot steam, caused by the less heat-conductive material, from escaping through the soleplate base. Instead, any droplets of condensate which may form are absorbed by the capillary layer, ultimately evaporating again on the hotter parts of the soleplate base. The impermeable layer, which is arranged on top of the capillary layer and lies in direct contact with the ironing side of the electric steam iron, has several functions. Imperviousness to liquids and steam prevents any lime contained in the steam from depositing between the pressing surface of an electric steam iron and the insert. If used without the impermeable layer the pressing surface, following use with the ironing shoe, would be covered with lime particles which would then be applied directly to the article being ironed. Furthermore, the impermeable layer contributes to ensuring that the steam flows from top to bottom and not vice versa, meaning that the layer also acts as a seal relative to the pressing surface of the iron. The impermeable layer has not only impermeable characteristics but is also resistant to high temperatures, enabling it to be exposed to a maximum iron temperature of 240° C. without the insert material suffering any impairment. Hence the capillary layer can be made of relatively low-cost material without the need of any heat-resistant coating or capillary layer. Furthermore, the impermeable layer affords ease of cleaning on account of its imperviousness to liquids and displays high abrasion and wear resistance so that the capillary layer does not become worn by regular fastening and releasing of the shoe fastener on the pressing surface of an electric steam iron. Finally, the impermeable layer prevents the pressing surface of the iron from sticking to the shoe.

The insert arrangement is preferably constructed so that an average temperature of 175° C. to 210° C. applied to the impermeable layer is reduced to an average temperature of 90° C. to 120° C. on the underside of the soleplate base. The insert is constructed so that this reduction of temperature of the pressing surface of an electric steam iron equals an adjustment from a 3-point setting to a 1-point setting corresponding to an average temperature of the shoe's pressing surface. Hence the ironing shoe insulates or reduces an applied temperature by at least around 40 or 55 Kelvin. A higher temperature insulating effect by the shoe of up to 120 or 150 Kelvin and more is also achievable. The shoe is intended in particular for an electric steam iron having a drip valve and a steam generating chamber so that water drips from the water tank into the steam generating chamber in the steam iron itself, independently of external steam generators, enabling steam to be produced there as a function of the temperature setting, starting at a temperature corresponding to the 2-point setting (=125° C. to 160° C.). Nearly the maximal amount of steam is produced in the 3-point temperature setting of the electric steam iron. On the other hand it is desirable for more sensitive types of fabric, which should be ironed only in the 1-point setting (average temperature of 90° C. to 120° C. at the pressing surface), to be also steam ironed with the shoe so that any type of article (including synthetic items) can very easily be ironed, crease-free, with the aid of hot steam and the shoe. The formation of shiny areas by the shoe is also prevented.

In a further advantageous embodiment the soleplate base is made of aluminum, particularly of aluminum surface-hardened by anodizing. In addition to the known outstanding forming properties of aluminum, which are important particularly for pressing surfaces with their numerous beads and indentations and cutouts, aluminum displays very high thermal conductivity. In addition to this there is also a special advantage to using aluminum as the material for the soleplate base of an ironing shoe because it exhibits high thermal emissivity and so contributes to maintaining the desired low temperatures at a constant level throughout the periods of different iron uses so that, for example, after putting down the iron in vertical position it does not overheat the item being ironed if used immediately afterwards. Advantageously, at least the pressing surface of the soleplate base is surface-hardened by anodizing or hard-anodizing.

In a still further advantageous embodiment the capillary layer is made of a fabric material, particularly polyester mat. Other moisture-absorbing fabric materials such as PPS, PE or cotton, other mat materials or fabrics can also be used for the capillary layer. High-temperature-resistant materials such as Nomex and Kevlar or the like are less preferred for cost reasons and are not necessary with the structure selected here because the impermeable layer already protects the underlying capillary layer from excessive contact heat on account of its high heat resistance.

In a further advantageous embodiment the ironing shoe is provided with a seal to prevent steam escaping from the outer upper edge. The purpose of the seal is to prevent hot steam escaping from the gap between the circumferential edge of the shoe and the circumferential edge of the steam iron in addition to the venting of steam through the soleplate openings. The seal prevents steam from escaping from underneath the insert between the insert and the soleplate base as well as from above the insert between the insert and the pressing surface of the electric steam iron outwards in the direction of the upper edge. This is accomplished, for example, by applying increased pressure in urging the insert in the outer edge zones against the pressing surface of the iron. For this purpose provision is made either for a circumferential silicone adhesive seal, which changes the height of the insert at the edge, or preferably for a second capillary layer which is of an annular configuration shaped to conform to the outer contour of the soleplate base so that the insert is pressed more in this outer zone by the steam iron against the soleplate base.

In an advantageous further aspect the impermeable layer is made of an aluminum material. The aluminum material has all the properties required of this layer: It is impermeable to liquid and steam, is resistant to high temperatures, can very easily be punched and formed, and has adequate wear resistance. Alternatively, it is possible to use Kapton, other rust-proof materials, PTFE, PPS, silicone and glass fiber materials.

In advantageous manner, the insert openings are formed as cutouts in the impermeable layer and in the capillary layer in the front area of the nose portion and in laterally adjoining areas near the lateral contours of the soleplate base. The shoe is intended for a steam iron having steam discharge ports arranged in a U or V pattern with the point of the V at the end close to the iron's nose portion. The steam discharge ports/soleplate openings in the soleplate base are arranged essentially for registration with the steam discharge ports in the pressing surface of the steam iron. An essential difference is that in the steam iron the discharge ports are arranged in slot-like or tear-shaped bead recesses in which there are individual circular openings for the steam to exit, whereas the steam discharge ports in the ironing shoe are not provided with individual circular openings but as elongated openings. To enable an unimpeded flow of steam between these two steam discharge ports, the insert in these areas has cutouts provided in both the impermeable layer and the capillary layer.

The soleplate base is preferably constructed in the form of a trough whose edge in the area of the nose portion is bent inwardly at an acute angle and at the opposite end is bent upwardly at essentially right angles so that a steam iron can be placed first under the edge of the nose portion for attachment and then lowered onto the opposite rear area of the soleplate base. Unlike the ironing shoes known from the art, which in the area of the nose portion have no bevel and are therefore less suited for ironing shirt pockets and shirt sleeves, this option remains possible when attaching the shoe to the steam iron. Furthermore, the inward bevel of the soleplate base serves the added function of securing the shoe to the steam iron in a simple positive-engagement relationship thereto in one end area without needing any further fastening means because this particular nose area of the edge of the soleplate base, which is inwardly bent at an acute angle, embraces the nose area of the edge of the steam iron, which is inwardly bent at an acute angle, in a positive-engagement relationship thereto. Accordingly, the steam iron is guided first under this edge zone of the soleplate base in the area of the nose portion and then simply lowered onto the shoe's rear area.

The fastening device is advantageously equipped with a spring-loaded snap fastener which snap-locks into place automatically for fastening to the steam iron. This snap fastener is positioned in the shoe's rear area, that is, in the area remote from the nose portion. It is thus possible to fasten the steam iron to the shoe without using your hands. This is important inasmuch as at least the steam iron is usually hot.

In an advantageous further aspect the fastening device is fabricated from a poor heat-conducting material, particularly a plastic material, with which the user disconnects the shoe from the steam iron when required. It is thus possible for the user to simply place one hand on the handle of the steam iron and the other hand on the plastic fastening device and to pull back the fastening device against the bias of the spring, holding only the steam iron tightly and guiding it upwards, in order very simply to disconnect the steam iron from the shoe.

Advantageously, the present invention also relates to an electric steam iron having a detachable shoe in accordance with at least one of the above mentioned features.

Further objects, advantages, features and application possibilities of the present invention will become apparent from the subsequent description of an embodiment in conjunction with the accompanying drawing. It will be understood that any single feature and any meaningful combination of single features described and/or represented by illustration form the subject-matter of the present invention, irrespective of their summary in the patent claims or their back references.

DESCRIPTION OF THE PREFERRED EMBODIMENTS

Figure 1:
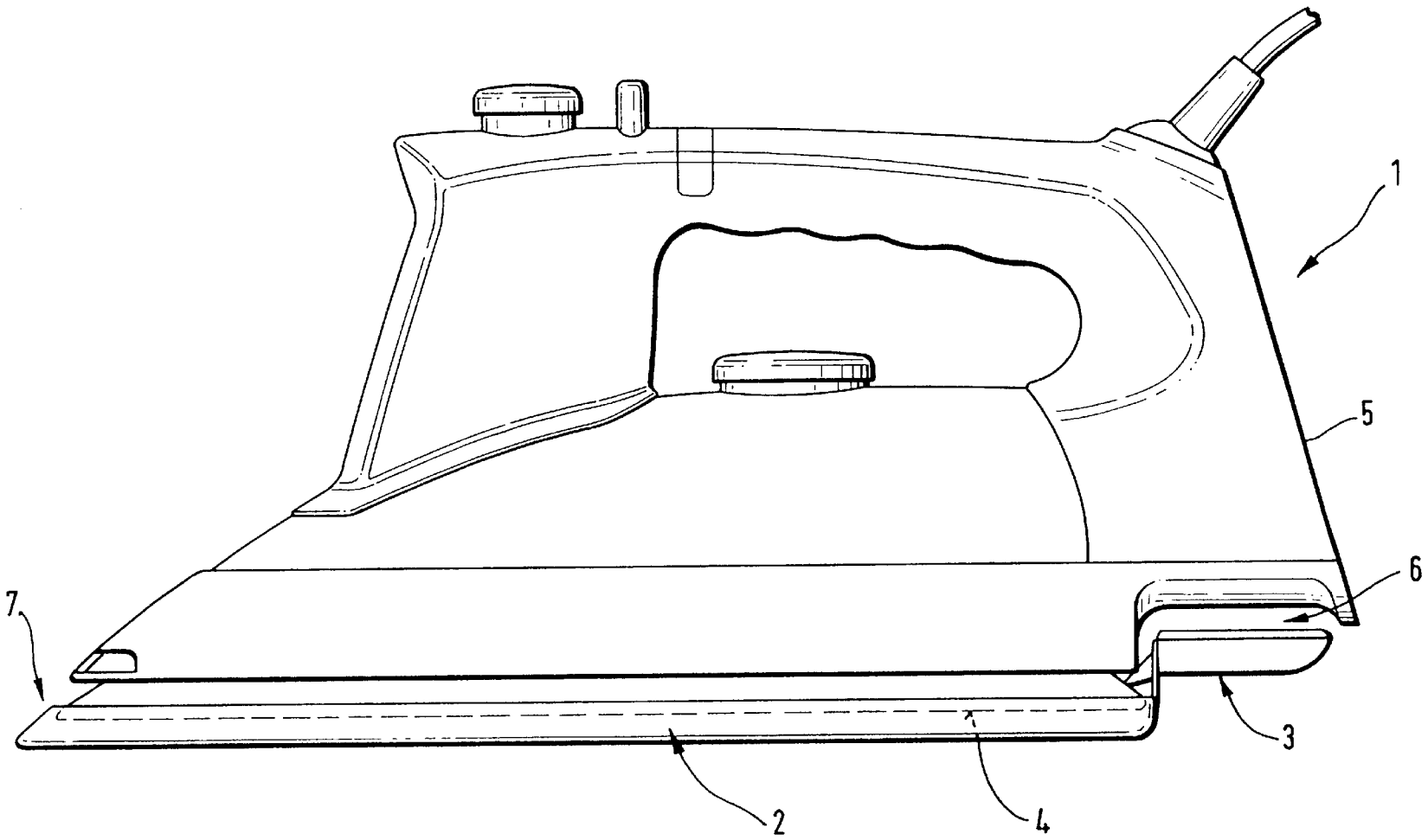
FIG. 1 is a view of an electric steam iron showing the ironing shoe of the present invention attached thereto.

FIG. 1 shows an electric steam iron 1 having an ironing shoe 2 attached thereto.

The ironing shoe 2 is designed for steam irons 1 which have a steam generator in the steam iron 1 and are preferably not of the boiler type but feature a steam pressure approximately equal to the gravity steam pressure in normal steam ironing mode. This condition is fulfilled by a water tank which communicates via a drip valve with the steam generating chamber of the electric steam iron 1 so that water continuously drips into the steam generating chamber, evaporating instantly. From there the steam reaches the steam discharge ports in the pressing surface 4 of the electric steam iron 1 and is directed, essentially without obstruction, through the ironing shoe 2 in order to exit from the steam discharge ports 18 in the shoe 2 and penetrate the underlying article waiting to be ironed. The electric steam iron 1 is equipped with a temperature control device enabling the temperatures 1-point, 2-point and 3-point and somewhat higher to be set. The 1-point temperature setting corresponds, in accordance with the IEC standard, to an average temperature at the pressing surface of the steam iron of 90° C. to 120° C., the 2-point setting to an average temperature in the range of 125° C. to 160° C., and the 3-point setting to an average temperature at the pressing surface of the iron of 175° C. to 210° C. The steam iron can usually be set to a maximum ironing temperature of up to 240° C. This type of steam iron 1 with drip valve controlled steam generation normally permits steam generation starting at the 2-point temperature setting.

As becomes apparent from FIG. 1, a fastening device 3 is provided on the ironing shoe 2 at the opposite end to the nose portion 7 of the electric steam iron. The fastening device 3 is positioned in an area corresponding to a notch 6 in the electrical steam iron 1 extending from the rear end of the pressing surface 4 of the steam iron 1 to the heel rest 5 of the steam iron 1 for standing the steam iron in vertical position. This enables the fastening device 3 to be easy to reach with the fingers while, in addition, this position of the fastening device 3 does not impair the steam iron 1 in its various conditions of use nor in its outer appearance. Placing the steam iron 1 down on its heel rest 5 in a vertical position is still possible as before because the fastening device 3 is positioned between the rear end of the pressing surface 4 of the steam iron and the heel rest 5.

Figure 2:
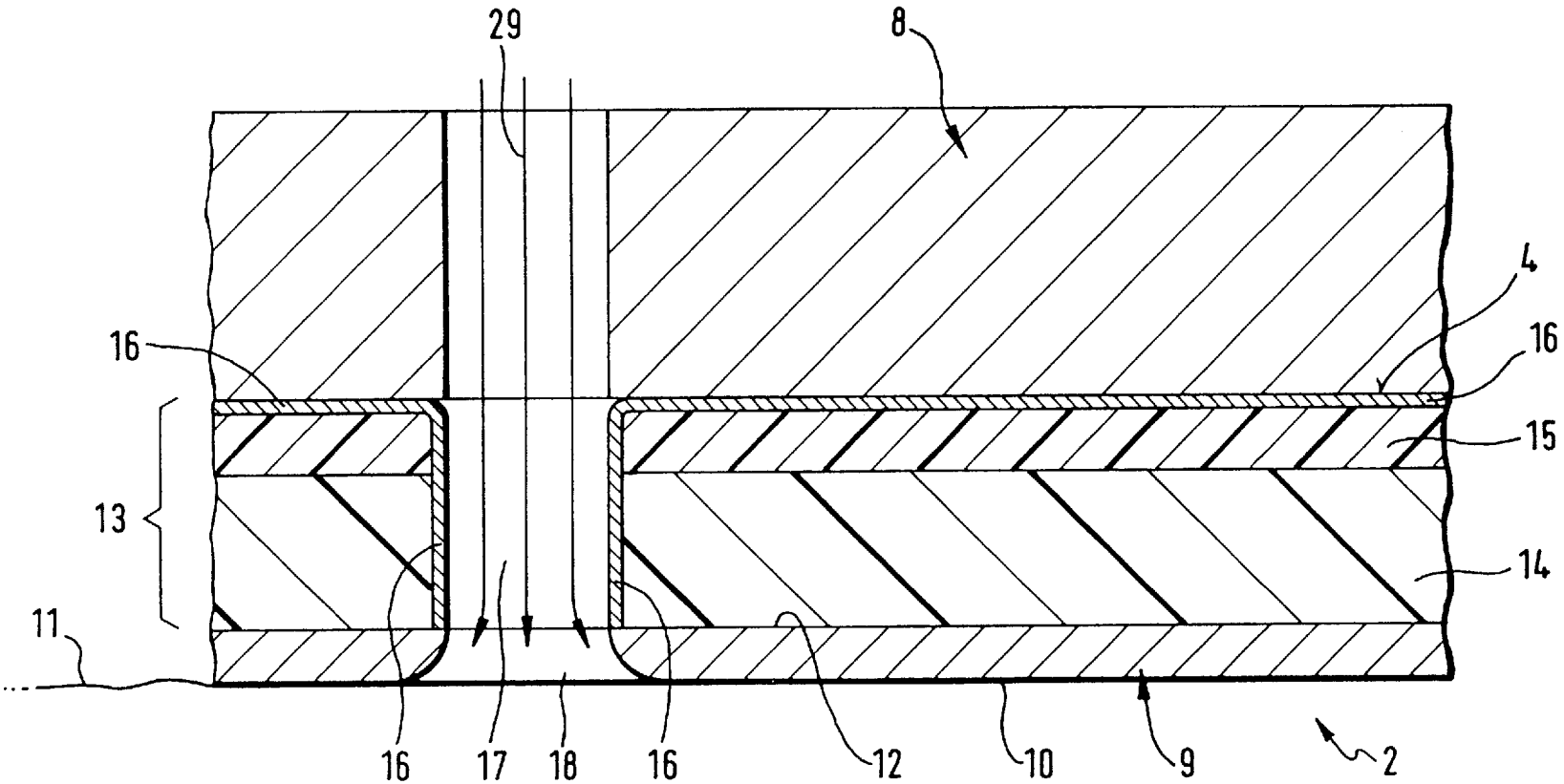
FIG. 2 is a schematic sectional view of the ironing shoe and the soleplate of the electric steam iron of FIG. 1.

FIG. 2 shows a sectional view of the ironing shoe 2 and the soleplate 8 of the electric steam iron.

The ironing shoe 2 includes a soleplate base 9 having essentially the same contour shape as the pressing surface 4 and the soleplate 8 of the electric iron. The underside 10 of the soleplate base 9 is the surface which makes contact with the item to be ironed 11 when the ironing shoe is attached to the electric iron. The soleplate base 9 has a multiplicity of tear-shaped or elongated steam discharge ports or soleplate openings 18 arranged in such a way as to be directly underneath the steam discharge ports of the electric steam iron 1.

The soleplate base 9 is made preferably from rolled aluminum plate between 0.5 and 1.2 mm thick, preferably 0.8 mm. On account of the desired lower ironing temperature on the underside 10 of the soleplate base 9, an aluminum soleplate base made of this relatively thin plate is ideal for a low mass value of the shoe 2 because it makes it easier to provide a lower temperature on the underside 10. The soleplate base 9 has its underside 10 surface-hardened preferably by hard anodizing or by anodizing. Good sliding characteristics are thus possible together with good resistance to scratching and high thermal emissivity. The high thermal emissivity contributes to maintaining the temperatures on the underside of the soleplate base at a low level. Alternatively it is also possible to use a PTFE coating as soleplate coating. The insert 13 of the ironing shoe 2 is positioned on the upper side 12 of the soleplate base 9. The insert 13 includes at least one capillary layer 14, 15 and an impermeable layer 16. In this preferred embodiment the capillary layer is made of a thicker polyester layer 14 and a thinner polyester layer 15. The function of the capillary layer is to absorb moisture in addition to reducing the transfer of heat. Particularly outstanding temperature resistance is not necessary because this function is performed by the superposed impermeable layer 16. The impermeable layer 16 is made of a very thin aluminum sheet material of a thickness of preferably between 0.2 and 0.4 mm, preferably 0.3 mm. This very thin material contributes to reducing the weight of the ironing shoe and hence to reducing the heat storage capacity, in addition to lending a certain flexibility which promotes sealing between the pressing surface and the impermeable layer 16, particularly toward the edge of the ironing shoe. The impermeable layer is impervious to liquid and gas, and in the area of the insert opening or steam passage opening 17 of the insert is bent over nearly all the way down to the capillary layer. Hard anodizing is particularly advantageous for an iron's shoe because the higher emissivity of the hard-anodized surface compared to an untreated or otherwise treated aluminum surface permits the use of a thinner (insulating) insert 13, thus enabling the shoe to heat up in shorter time.

FIG. 2 shows how the steam 29 exits unobstructed the steam discharge ports of the electric iron 1 through the insert opening 17 and the soleplate opening 18. This unimpeded passage of steam is important particularly on this type of steam iron operating with gravity steam pressure and without boiler or external steam generating source because then sufficient steam penetrates the article to be ironed 11. The steam passage opening or insert opening 17 and the soleplate opening or steam discharge port 18 are arranged underneath the steam outlet of the steam iron so as to register therewith.

Figure 3:
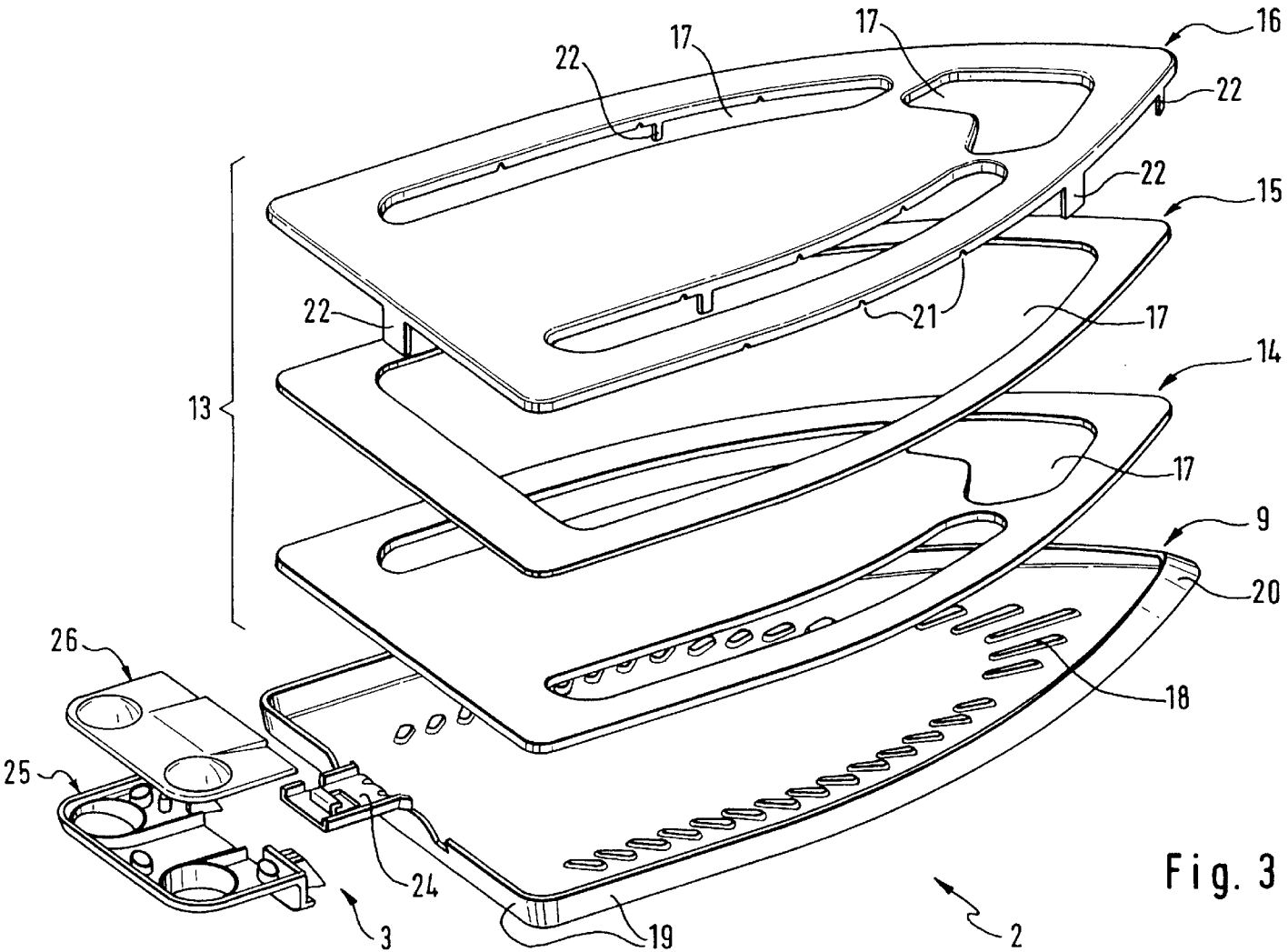
FIG. 3 is an exploded view of all the components of the ironing shoe of FIG. 1.

FIG. 3 shows an exploded view of the components of the ironing shoe 2. The soleplate base 9 has a generally trough-shaped configuration, with the lateral flanks or edges in the rear and rear lateral area 19 being aligned essentially vertically so as to include an angle of at least 90° with the upper side 12 of the soleplate base 9. By contrast, the lateral edge 20 in the area of the nose portion includes an acute angle of between 35° and 65° with the upper side 12 of the soleplate base 9 so that for attachment an electric steam iron 1 has to be guided under the lateral edges of the soleplate base 9 in the area of the nose portion, whereas it simply has to be lowered vertically in the rear area in proximity to the lateral edges 19 of the soleplate base 9. FIG. 3 also clearly shows the multi-layer structure of the insert 13 having insert openings 17 for passage of the steam in the approximately 2 to 3 mm thick lower capillary layer 14 and the impermeable layer 16, said openings being in the form of large cutouts shaped to conform to the U and V pattern of the steam discharge ports in the iron. Between the thicker capillary layer 14, which also has a capillary layer in the middle area of the pressing surface, and the impermeable layer 16 is an approximately annular capillary layer 15 which makes the insert 13 somewhat thicker in the edge zone than in the middle zone so that towards the edge there is tighter clamping of the pressing surface of the steam iron 1 against the impermeable layer 16 of the shoe 2. The unwanted discharge of steam in upward direction towards the user's hands between the shoe and the pressing surface of the steam iron is thus prevented. It will be understood, of course, that this edge sealing can be also accomplished by other design measures, as by introducing silicone rubber in the edge zone or the like.

The impermeable layer 16 is made by forming a plane piece of aluminum sheet in such a way that a circumferential edge is formed around the outside as well as an enclosing circumferential aluminum edge around the cutouts forming the insert openings 17. Hence the capillary layers 14 and 15 are accommodated nearly completely within the three-dimensional body of the impermeable layer, with notches 21 being provided to prevent wrinkling. Furthermore, the impermeable layer 16 has lugs 22 which, after the capillary layer is enclosed by the lateral edge walls of the impermeable layer, are bent over again so that in their end areas the lugs are arranged in one plane parallel to the upper surface of the impermeable layer 16. After the appropriate holes are punched in the capillary layers and the impermeable layer, and the impermeable layer is formed to the required shape, the insert 13 is thus preassembled as a unit. Preferably, the insert 13 is adapted to be joined to the upper side of the soleplate base 9 by silicone adhesive joints between the bigger lugs 22 in the rear area and the two lateral areas of the impermeable layer 16. A variation is also possible, however, where the insert 13 can be replaced when worn by a new one designed to be fitted in the soleplate base 9.

To place the insert 13 in the soleplate base 9 the insert 13 is pushed, like the soleplate of the electric steam iron, first under the front area of the soleplate base in the area of the nose portion and then lowered vertically in the rear area under pressure, whereby snap wedges 23 of the fastening device 3 can be pushed, similar to the fastening of the steam iron to the ironing shoe, to the rear against the spring force. The insert 13 is therefore enclosed in the front area by the lateral wall protruding inwardly at an acute angle, the edge of the soleplate base 9, while being held in the rear area by the snap wedges 23 (see FIG. 4).

Figure 4:
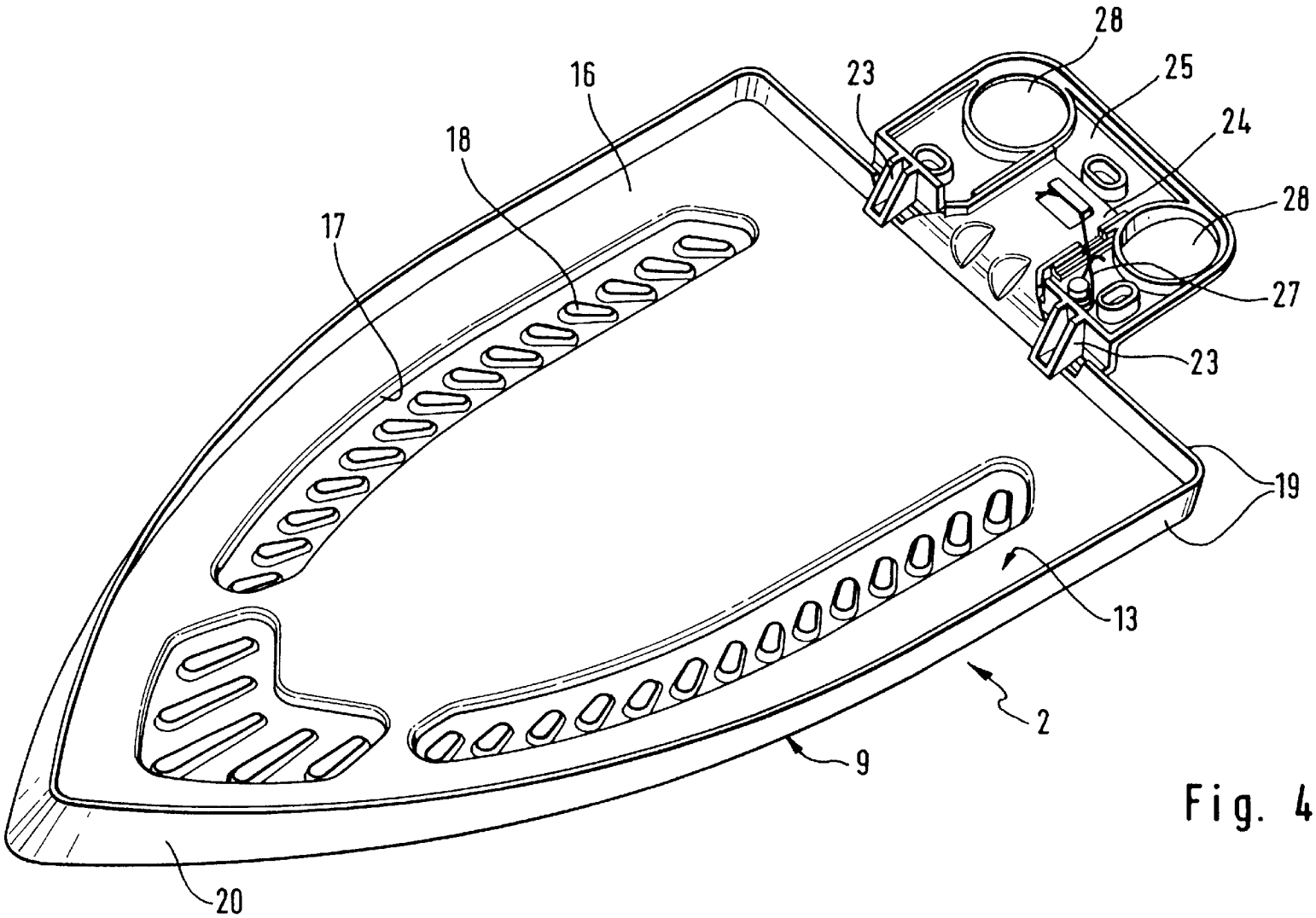
FIG. 4 is a view looking at an angle from above onto the ironing shoe, but absent the upper part of the fastening device of FIG. 1.
Figure 5:
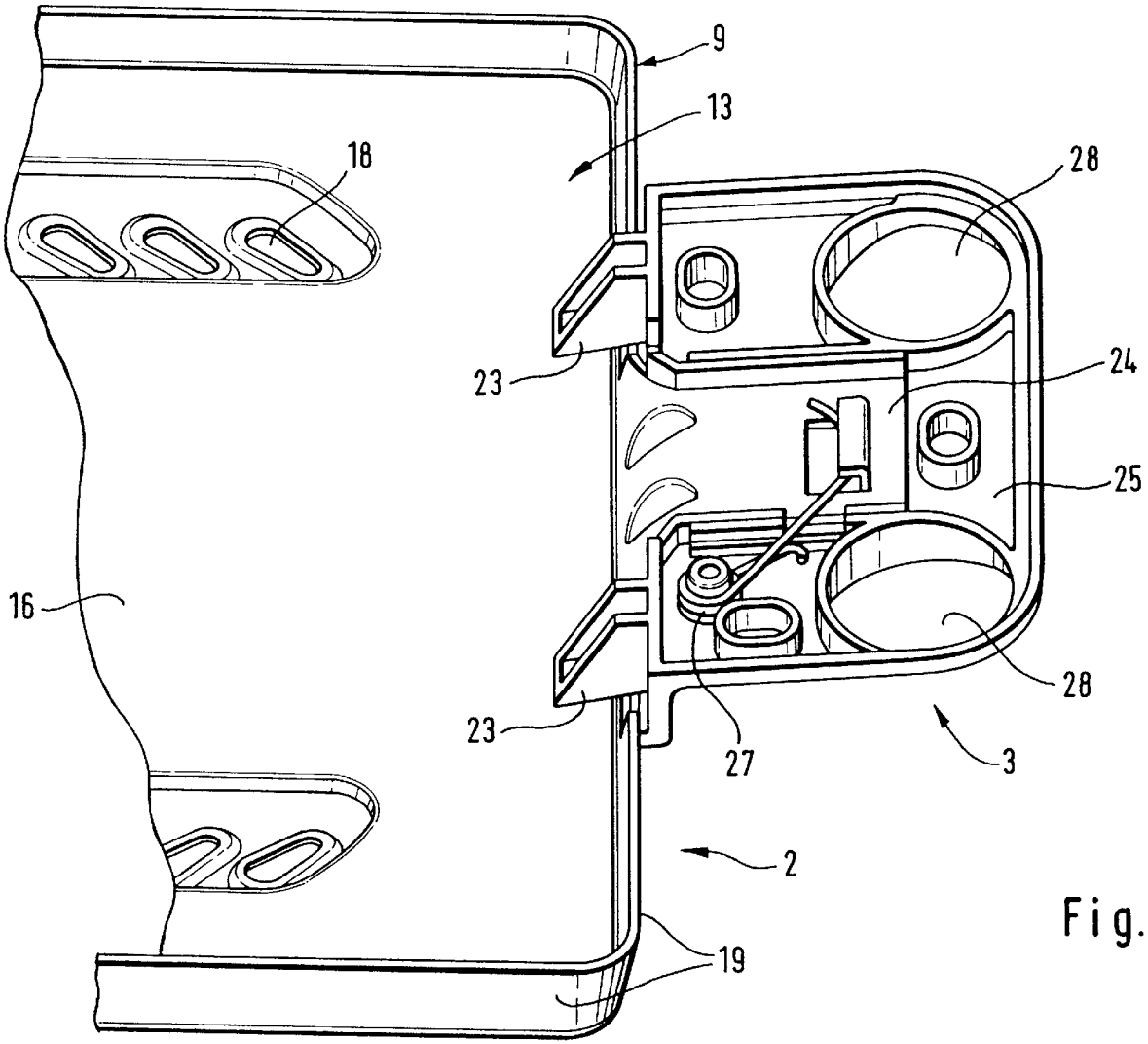
FIG. 5 is an enlarged view of the fastening device of the ironing shoe, absent the upper part of FIG. 1.

The fastening device 3 as shown in particular in FIGS. 3, 4 and 5 will now be described. The fastening device is comprised of a lower part 25, an upper part, a spring 27 and a tongue 24 of the soleplate base 9. The soleplate base is advantageously equipped in the rear area, meaning the area at the end remote from the nose portion, with a tongue 24 to which the lower part 25 can be fastened. Provided in the lower part and in the tongue are supporting devices for a spring 27, enabling the entire lower part to be moved relative to the tongue and hence to the soleplate base 9. The snap wedges 23 are integrally formed on the lower part so that when the lower part is moved against the spring force of the spring 27 in a direction away from the nose portion, the snap wedges 23 are moved away from the bounding lateral edge 19 of the soleplate base, enabling an attached iron to be removed from its rear anchorage. When the iron is placed down on the snap wedges 23 they cause, by virtue of their wedge shape, the lower part 25 to be shifted under the weight of the iron to the rear against the spring force of the spring 27 so that the iron is held by the fastening device. The snap wedges are constructed to project in such a way that they reach further into the soleplate base in a lower area than in an upper area. The lower part 25 also has two openings 28 suitable for engagement with a user's two fingers to release the connection between the shoe attachment and the steam iron. The fastening device 3 further comprises the upwardly covering upper part 26 which is clipped onto the lower part 25. It should be noted that FIG. 3 shows the fastening device with the tongue 24, the lower part 25 and the upper part 26 components, whereas FIGS. 4 and 5 show the added provision of the spring 27, the upper part having been omitted for improved clarity of illustration of the remaining components of the fastening device 3. The lower part 25 and the upper part 26 are fabricated from plastic material so that the user needs only to reach into the openings 28 of the lower part 25, using his other hand for holding the iron by the handle in order to disconnect the hot shoe from the rest of the steam iron. Hence there is no risk of the user touching any hot parts of the iron.

In an alternative embodiment a lime screen, for example, in the form of a thin mat, is accommodated in the area of the cut-outs for the insert openings for enhanced control of the lime deposits. In a further embodiment a wire mesh, wire netting or the like is inserted between the impermeable layer and the capillary layer so that a further lowering of the temperature is accomplished in the insert without need of high-cost temperature-resistant coatings.

In yet another embodiment the soleplate opening features a constructional arrangement of the type in which steam is discharged not only from underneath the shoe but also laterally forwardly. For this purpose the slots 18 are extended to the edge as beads, for example, causing the steam to be directed outwardly.

What is claimed is:

1. An ironing shoe for an electric steam iron, the ironing shoe comprising:

a fastening device for fastening and releasing the ironing shoe to a pressing surface of the electric steam iron;

a soleplate base having soleplate openings for the discharge of steam and having an underside for ironing an article and an upper side; and an insert arrangement disposed on the upper side of the soleplate base having insert openings for the passage of steam from the steam iron to the soleplate openings;

wherein the insert arrangement is configured in such fashion that an average temperature of 175° C. to 210° C. prevailing on the side of the ironing shoe close to the pressing surface of the steam iron is reduced to an average temperature of 90° C. to 110° C. on the underside of the soleplate base.

2. The ironing shoe of claim 1, wherein the insert arrangement comprises a capillary layer made of a moisture-absorbing material arranged close to the upper side of the soleplate base, and an impermeable layer arranged on the side close to the steam iron.

3. The ironing shoe of claim 2, wherein the capillary layer comprises a fabric material.

4. The ironing shoe of claim 3, wherein the fabric material is a polyester mat.

5. The ironing shoe of claim 1, wherein the soleplate base comprises aluminum.

6. The ironing shoe of claim 5, wherein the aluminum is surface-hardened by anodizing.

7. The ironing shoe of claim 1, further comprising a seal to prevent steam from escaping from between the ironing shoe and the electric steam iron.

8. The ironing shoe of claim 2, wherein the impermeable layer is made of an aluminum material.

9. The ironing shoe of claim 2, wherein the insert openings are formed as cutouts in the impermeable layer and in the capillary layer in the front area of a nose portion and in laterally adjoining areas near lateral contours of the soleplate base.

10. The ironing shoe of claim 9, wherein the soleplate base is constructed in the form of a trough whose edge in the area of the nose portion is bent inwardly at an acute angle and at an opposite end is bent upwardly at essentially right angles so that the electric steam iron can be guided first under the edge of the nose portion for attachment.

11. The ironing shoe of claim 1, wherein the fastening device comprises a spring-loaded snap fastener which snap-locks into place automatically for fastening to the steam iron.

12. The ironing shoe of claim 11, wherein the fastening device is fabricated from a poor heat-conducting material and is connected with the spring-loaded snap fastener, with the poor heat-conducting material being adapted to move against the spring force of the snap fastener in order to release the fastener from the ironing shoe.

13. The ironing shoe of claim 12, wherein the poor heat-conducting material is a plastic material.

14. The ironing shoe of claim 11, wherein the snap fastener includes snap wedges.

15. An appliance, comprising:

an electric steam iron; and a detachable ironing shoe as claimed in any one of the claims 1 to 12 attached to the electric steam iron.

16. The ironing shoe of claim 1, wherein the insert arrangement comprises a permeable layer.

17. The ironing shoe of claim 16, wherein the insert arrangement further comprises an impermeable layer, and the permeable layer is located between the impermeable layer and the upper side of the soleplate base.

* * * * *

UNITED STATES PATENT AND TRADEMARK OFFICE

CERTIFICATE OF CORRECTION

PATENT NO. : 6,539,651 B1 
DATED : April 1, 2003
INVENTOR(S) : Xavier Cuesta Mundet et al.

It is certified that error appears in the above-identified patent and that said Letters Patent is hereby corrected as shown below:

Title page,
Item [75], Inventors, delete "Desideri Falco" and insert -- Desideri Falco Sastre --; also delete "Pedro Perez" and insert -- Pedro Perez Gonzalez --

Signed and Sealed this

Sixth Day of April, 2004

JON W. DUDAS
*Acting Director of the United States Patent and Trademark Office*